US007959002B2

(12) United States Patent
Liao et al.

(10) Patent No.: US 7,959,002 B2
(45) **Date of Patent: *Jun. 14, 2011**

(54) AIR ENCLOSURE WITH MULTILAYER DIFFERENT KINDS OF SUBSTRATES

(75) Inventors: Chian Hua Liao, Sindian (TW); Yao Sin Liao, Sindian (TW); Bo Xin Jian, Sindian (TW); Yao Chuan Liao, Sindian (TW)

(73) Assignee: Yao Sin Liao, Sindian (TW)

( * ) Notice: Subject to any disclaimer, the term of this patent is extended or adjusted under 35 U.S.C. 154(b) by 103 days.

This patent is subject to a terminal disclaimer.

(21) Appl. No.: 11/743,053

(22) Filed: May 1, 2007

(65) Prior Publication Data

US 2008/0063315 A1 Mar. 13, 2008

(30) Foreign Application Priority Data

Sep. 7, 2006 (TW) ..... 95133068 A

(51) Int. Cl.
*B65D 30/10* (2006.01)

(52) U.S. Cl. ..... 206/522; 383/3

(58) Field of Classification Search ..... 206/522; 383/3, 44; 428/35.2

See application file for complete search history.

(56) References Cited

U.S. PATENT DOCUMENTS

| | | | | |
|---|---|---|---|---|
| 5,469,966 | A * | 11/1995 | Boyer | 206/522 |
| 5,755,329 | A * | 5/1998 | Sadow | 206/522 |
| 5,912,058 | A * | 6/1999 | Takahashi et al. | 428/34.3 |
| 2003/0094395 | A1 * | 5/2003 | Peper et al. | 206/522 |
| 2005/0013974 | A1 * | 1/2005 | Koyanagi | 428/178 |
| 2005/0109411 | A1 * | 5/2005 | Koyanagi | 137/846 |

FOREIGN PATENT DOCUMENTS

| | | | |
|---|---|---|---|
| JP | H04-128273 | U | 11/1992 |
| JP | H05-508142 | A | 11/1993 |
| JP | H06-020041 | U | 3/1994 |
| JP | H06-022267 | U | 3/1994 |
| JP | H09-099979 | A | 4/1997 |
| JP | H11-334762 | A | 12/1999 |
| JP | 2002-019845 | A | 1/2002 |
| JP | 2002-234577 | A | 8/2002 |
| JP | 2003-252376 | A | 9/2003 |
| JP | 2003-292047 | A | 10/2003 |

* cited by examiner

*Primary Examiner* — J. Gregory Pickett
*Assistant Examiner* — King M Chu
(74) *Attorney, Agent, or Firm* — Rabin & Berdo, P.C.

(57) ABSTRACT

An air enclosure with multilayer different kinds of substrates comprises an air cylinder sheet, at least one air chamber, at least one air entering passageway and a sheet body in which the air cylinder sheet comprises an air filling passageway; the chambers is positioned at one side of the air filling passageway and used for providing an article with the cushioning protection; the air entering passageway is connected to the air filling passageway and the chambers and outside air in the air filling passageway enters the air chamber via the air entering passageway to allow it to be filled with air and expanded; and the sheet body is closely attached onto one side of the air cylinder sheet and used for preventing the air cylinder sheet from being pierced through to damage. The outside air expands the air filling passage while being filled with air and then enters the air chambers via the air entering passageways to allow them to be filled with air and expanded thereby providing the article with the cushioning protection through the air chambers and the sheet body is used to prevent the air chamber from being pierced through to cause air to be leaked out.

20 Claims, 23 Drawing Sheets

AIR ENCLOSURE WITH MULTILAYER DIFFERENT KINDS OF SUBSTRATES

CROSS-REFERENCES TO RELATED APPLICATIONS

This non-provisional application claims priority under 35 U.S.C. §119(a) on Patent Application No(s). 095133068 filed in Taiwan, R.O.C. on 2006/09/07, the entire contents of which are hereby incorporated by reference.

FIELD OF INVENTION

The present invention relates to an air enclosure, and more particularly to an air enclosure with multilayer different kinds of substrates.

BACKGROUND

A conventional way for packing an article with a cushioning agent mostly is wrapping around the article with a plastic sheet on which a plurality of small raised air bags are projected to attain to the shock-absorbed cushioning functions. But the shock absorption capability of the small air bags is limited such that the cushioning and the shock absorption effects to a larger shock or impulse cannot be attained. Therefore, an air packing bag is developed .to take as a wrapping cushioning means However, the air bag made from polyethylene (PE) is easy to be pierced through by a sharp acute angle of a packed article or an adjoining angle of hardware; once a small broken hole appears on the air packing bag, fluid in the air packing bag is then leaked out. If each air cylinder of the air packing bag is disposed with an independent check valve, it is limited to the air cylinder on which the broken hole is yielded leaks air, and is not to cause other unbroken air cylinders to leak air. But, if only one check valve is disposed in the whole air packing bag, the air in the whole air packing bag is then caused to leak out when the broken hole is generated on any air cylinder to cause the whole air packing bag to loose the cushioning protection effect.

Therefore, for not only improving a structure of an air packing bag, but also solving the problem that the air packing bag is pierced through by a packed article and preventing any air cylinder from being damaged to cause the whole air packing bag to loose the suffering protection effect, the present invention is proposed.

SUMMARY

The present invention proposes an air enclosure with multilayer different kinds of substrates adapted to wrap an article thereby providing a cushioning protection; it comprises an air cylinder sheet, at least one air chamber, at least one air entering passageway and a sheet body; in which the air cylinder sheet comprises an air filling passageway; the air chambers used for providing the cushioning protection for the article are disposed at one side of the air filling passageway; the air entering passageways are connected with the air filling passageway and the air chambers and outside air in the air filling passageway flows into the air chambers through the air entering passageways to fill air and expand them; the sheet body used for preventing the air cylinder sheet from being pierced through to damage is closely attached onto one side of the air cylinder sheet.

the outside air expands the air filling passageway when air is filled and then flows into the air chambers via the air entering passageways to allow them to be filled with air and expanded. A user can use a different shape and size of sheet body or case to wrap the article so as to provide the cushioning protection for the article through the air chambers and preventing the air chambers from being pierced through to allow the air to be leaked.

BRIEF DESCRIPTION OF THE DRAWINGS

The present invention can be more fully understood by reference to the following description and accompanying drawings, in which.

DETAILED DESCRIPTION

Figure 1A:
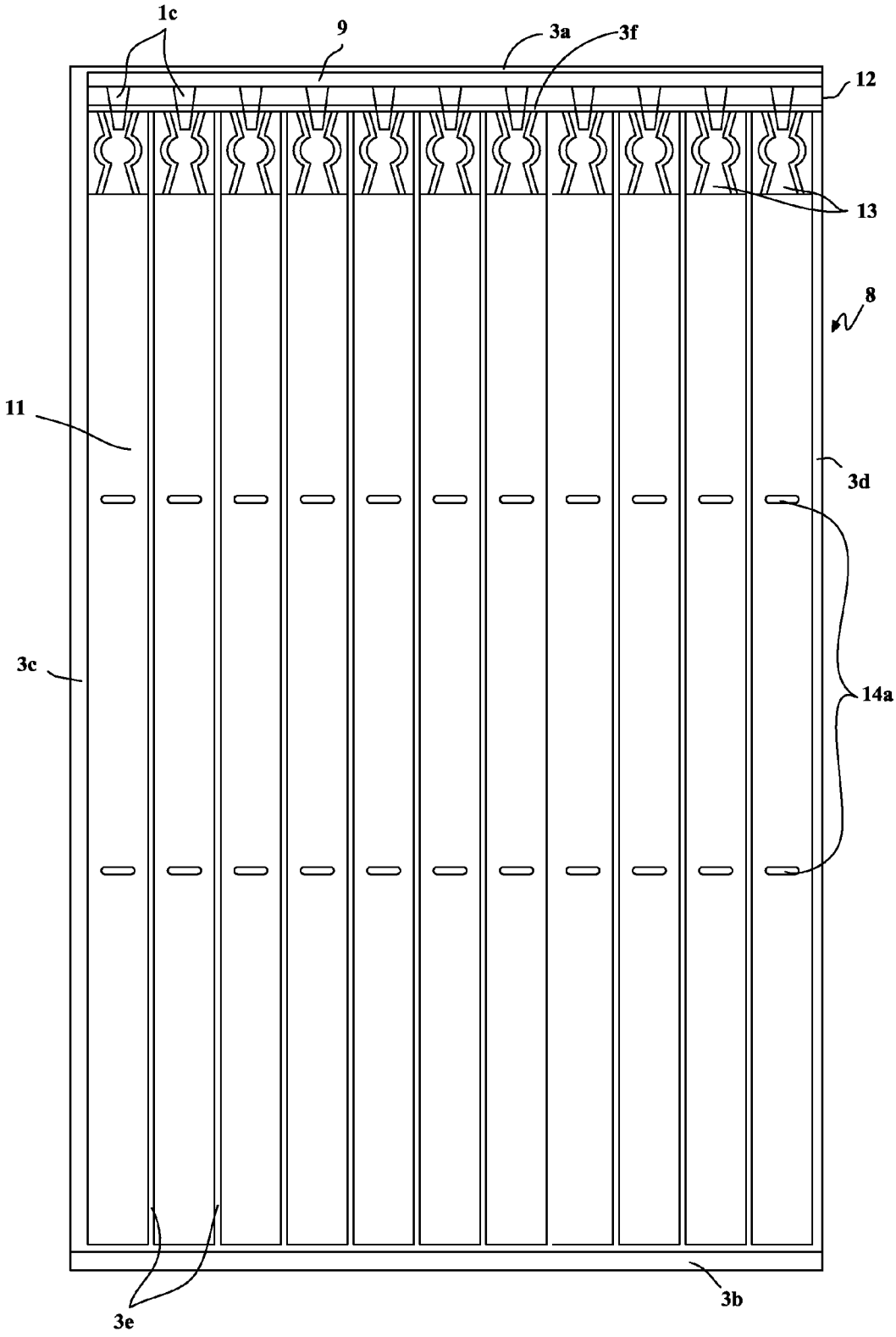
FIG. 1A is a plane view, showing an air enclosure before air is filled of a first preferred embodiment according to the present invention.
Figure 1B:
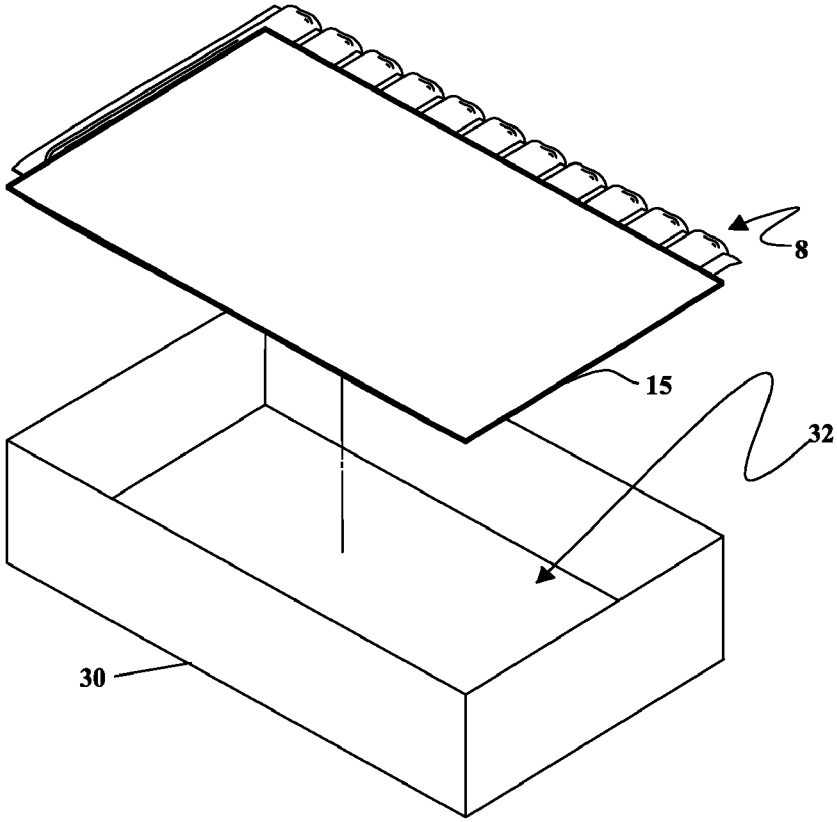
FIG. 1B is a perspective view, showing an air enclosure after air is filled of a first preferred embodiment of the present invention.
Figure 1C:
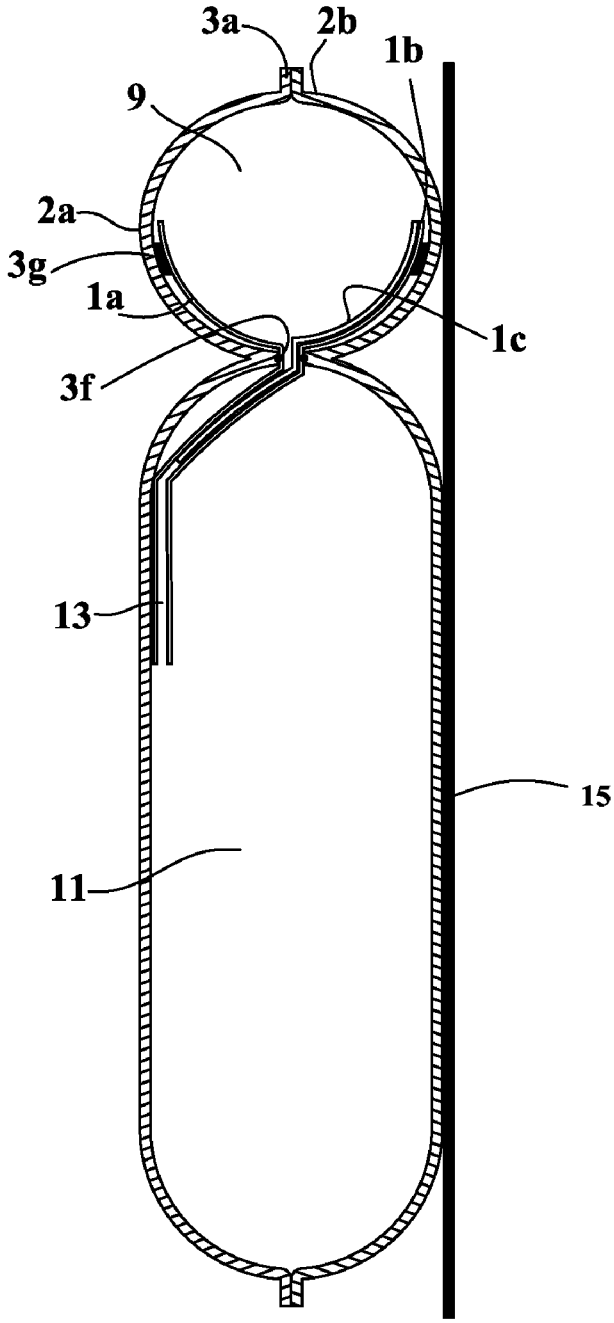
FIG. 1C is an air enclosure after air is filled of a first preferred embodiment according to the present invention.

Please refer to FIGS. 1A to 1C. FIG. 1A is a plane view showing an air enclosure before being filled with air of a first preferred embodiment according to the present invention. FIG. 1B is a perspective view showing an air enclosure after being filled with air of a first preferred embodiment according to the present invention. FIG. 1C is a cross sectional view showing an air enclosure after being filled with air of a first preferred embodiment according to the present invention.

An air enclosure 6 with multilayer different kinds of substrates comprises tow outer films 2*a* and 2*b*, two inner films 1*a* and 1*b*, an air filling passageway 9, air chambers 11, air entering passageways 13 and a sheet body 15.

Both outer films 2*a* and 2*b* are folded together vertically.

Both inner films 1*a* and 1*b* are attached on one side of the outer film 2*a* or 2*b*, and a heat resistant material 1*c* is spread between the inner films 1*a* and 1*b* so as to use the heat resistant material 1*c* as a passageway capable of allowing air to flow.

Hot sealing is processed along hot sealing lines 3*a*, 3*b*, 3*e*, 3*d*, 3*e* and 3*f* to form an. air cylinder sheet 8, in which hot sealing is used to adhere the outer films 2*a* and 2*b* and the inner films 1*a* and 1*b* together to allow the air filling passageway 9 to be formed between the outer films 2*a* and. 2*b*. More particularly, the air filling passageway 9 is formed by sticking the two outer films 2*a* and 2*b* together by the hot sealing line 3*a*, and sticking the two outer films 2*a* and 2*b* to the two inner films 1*a* and 1*b* by the hot sealing line 3*f*. In the air filling passageway 9 many hot sealing points 3*g* are positioned between the hot sealing lines 3*a* and 3*f*, and stick one of the outer films 2*a* and 2*b* to one of the inner films 1*a* and 1*b*, The air filling passageway 9 is passed through the hot sealing lines 3*e* and comprises an air inlet 12 through which outside air can be filled in. Furthermore, a plurality of air chambers 11 are formed by adhering the outer films 2*a* and 2*b* by means of hot sealing. Thereafter, hot sealing is processed on air chambers 11 to generate a plurality of nodes 14*a* to enable the air chambers 11 to be bended along the nodes 14*a*.

A heat resistant material 1*c* is spread separately and sequentially between the inner films 1*a* and 1*b*, for example, heat resistant resin or ink is printed to allow the inner films 1*a* and 1*b* not to be adhered to each other even after hot sealing is processed to form the air entering passageways 13.

The air cylinder sheets 8 can be spread in parallel, stacked in sequence or arranged in vertical disposition on one side of the sheet body 15 and fixed on the sheet body 15 through adhesive or fixed on one side of the sheet body 15 by means of hot sealing. Besides, the sheet body 15 can also be attached levelly on a surface of the air chambers 11. Moreover, the air chambers 11 can be bended to form multiple layers of air chambers folded to each other along the nodes 14*a* thereby providing the multilayer cushioning effect.

The sheet body 15 mentioned above is made from a soft material, for example, Polyvinylchloride (PVC), Polypropylene (PP), EPE. EPP, cloth or foam; it can also be made from corrugated paper, paper or paper-like material.

Air enters the air inlet 12 to expand the air filling passageway 9 to allow the inner films 1*a* and 1*b* to be pulled apart outward to open the air entering passageways 13 such that air in the air filling passageway 9 can be used to fill the air chambers 11 with air to cause the air chambers 11 to be filled with air and expanded. Because an air pressure at a curved portion of the air entering passageway 13 is larger than the one at two sides thereof, air in the air filling passageway 9 is allowed to enter easily and escape difficulty, and the curved portion of the air entering passageway 13 is pressed tightly when the pressure in the air chamber 11 is increased to attain to the air locking effect. Furthermore, the inner air pressure of the air chamber 11 presses the inner films 1*a* and 1*b* to allow them to be attached and pressed tightly on the outer film 2*a* or 2*b* to cause the air entering passageway 13 to seal the air chamber. Whereby, the air is not allowed to leak out so as to attain to the air locking effect.

After the air filling is completed, the sheet body 15 can then be used to wrap an article 20, thereby providing the article 20 with the cushioning protection through the air cylinder sheet 8 and preventing a sharp angle of the article 20 from piercing through the air cylinder sheet 8 to cause the air in the air chamber 11 to be leaked out.

According to the structure disclosed by the present invention, the inner films 1*a* and 1*b* and the outer films 2*a* and 2*b* are made from polyethylene (PE). Moreover, the air enclosure 5 with multilayer different kinds of substrates further comprises an outer box 30 on which an accepting space 32 is disposed; the article 20 can then be placed into the accepting space 32 of the outer box 30 after it is wrapped by the air cylinder sheet 8 and the sheet body 15 to allow a user to transport the article 20. Furthermore, the sheet body 15 can be bended to form a case 16; the case 16 comprises a filling space used for accepting the air cylinder sheet 8.

Figure 2A:
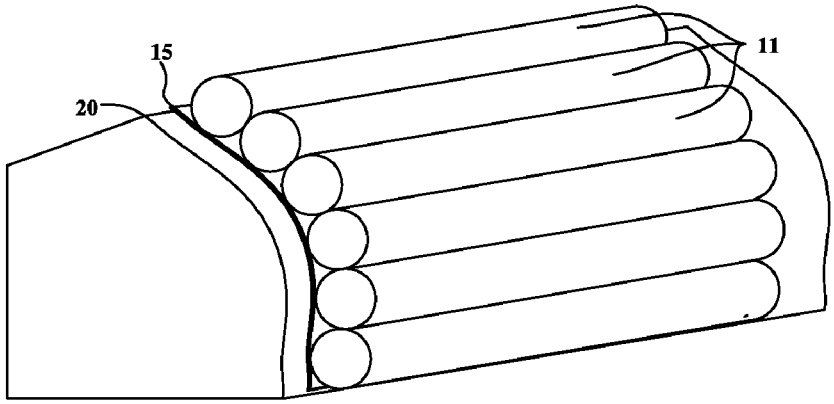
FIGS. 2B to 2D are schematic views, respectively showing a bended air enclosure of a first preferred embodiment according to the present invention.
Figure 2B:
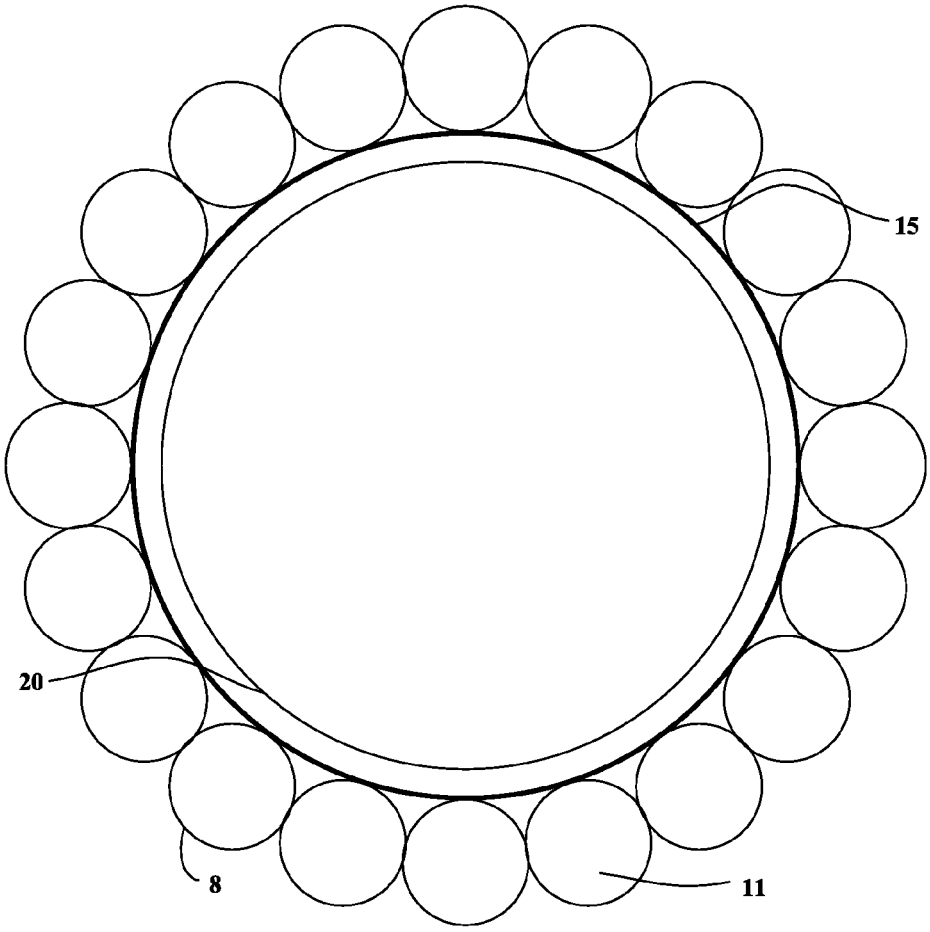
Figure 2C:
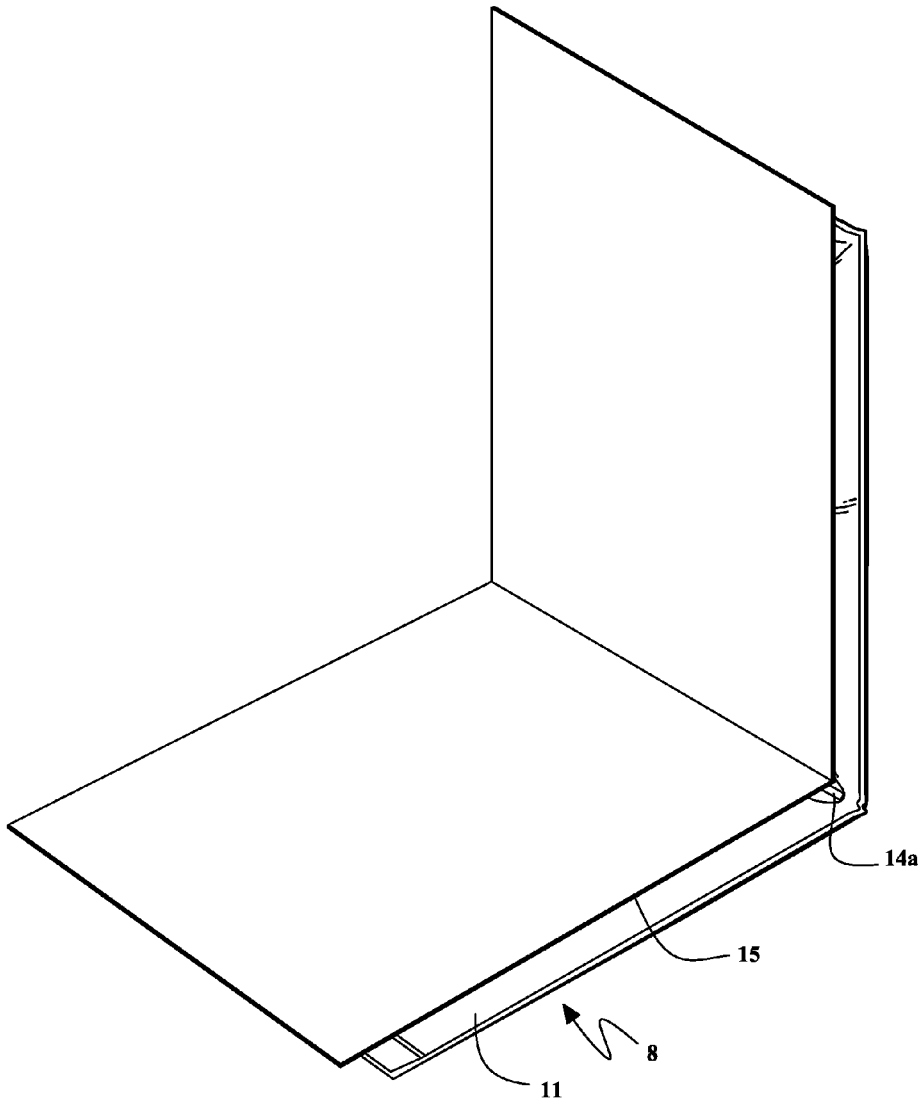
Figure 2D:
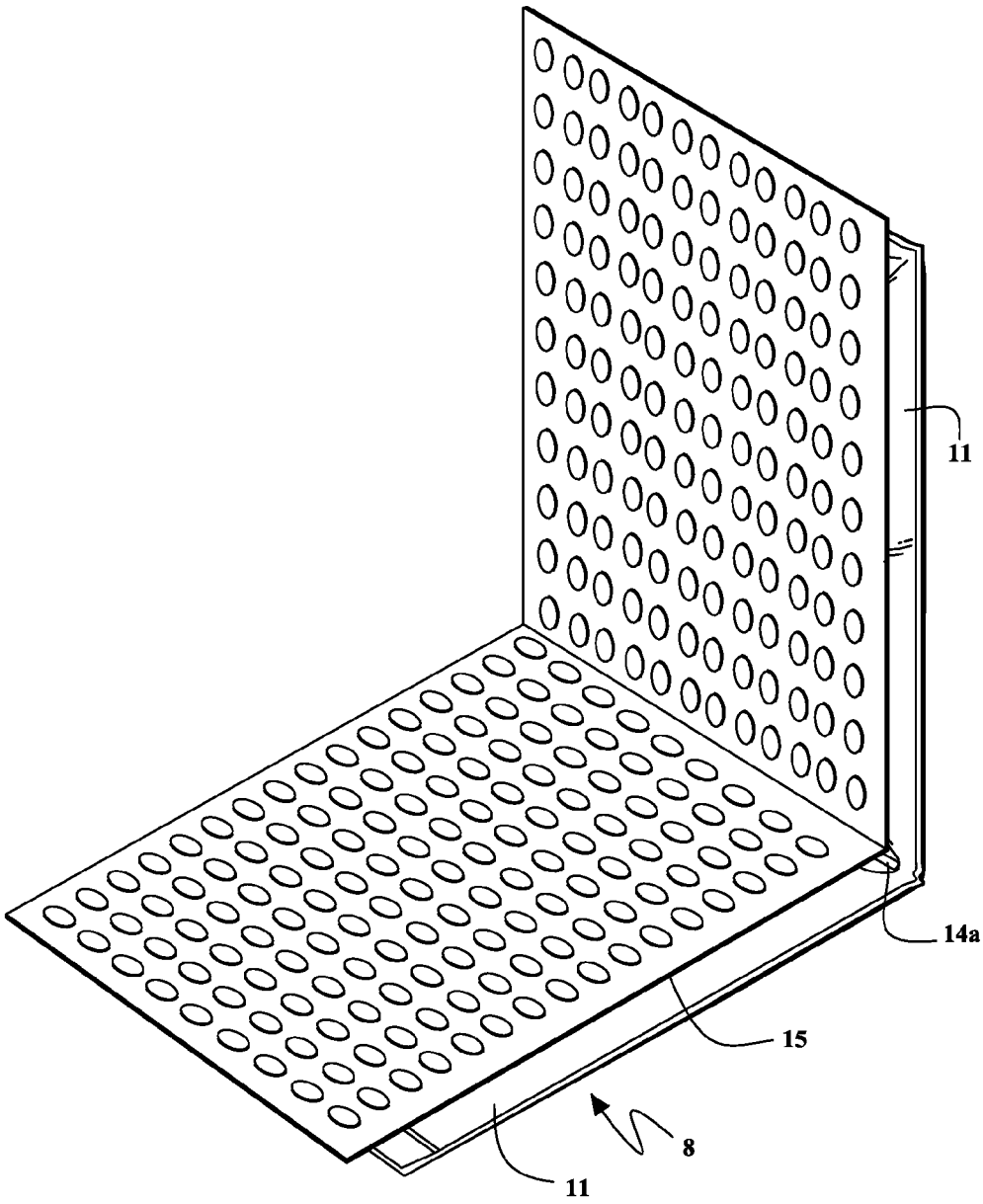
Figure 3A:
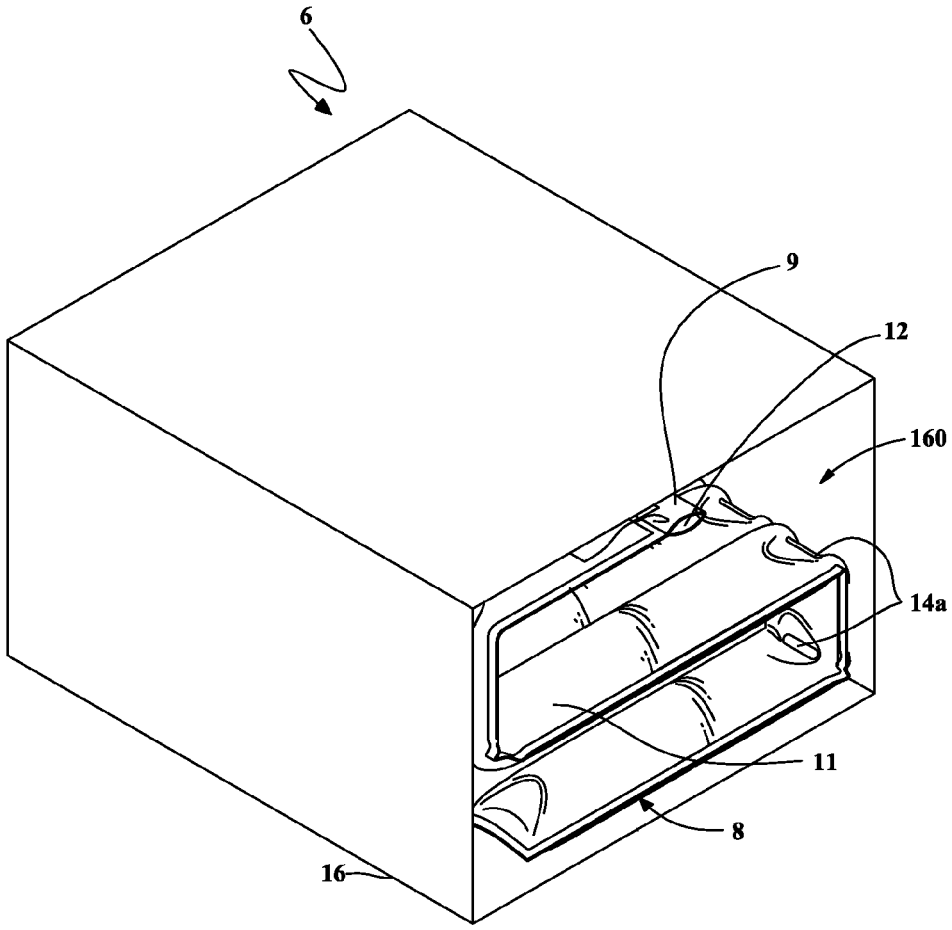
FIGS. 3A to 3D are schematic views, respectively showing an air enclosure after being filled with air of a second preferred embodiment according to the present invention.
Figure 3B:
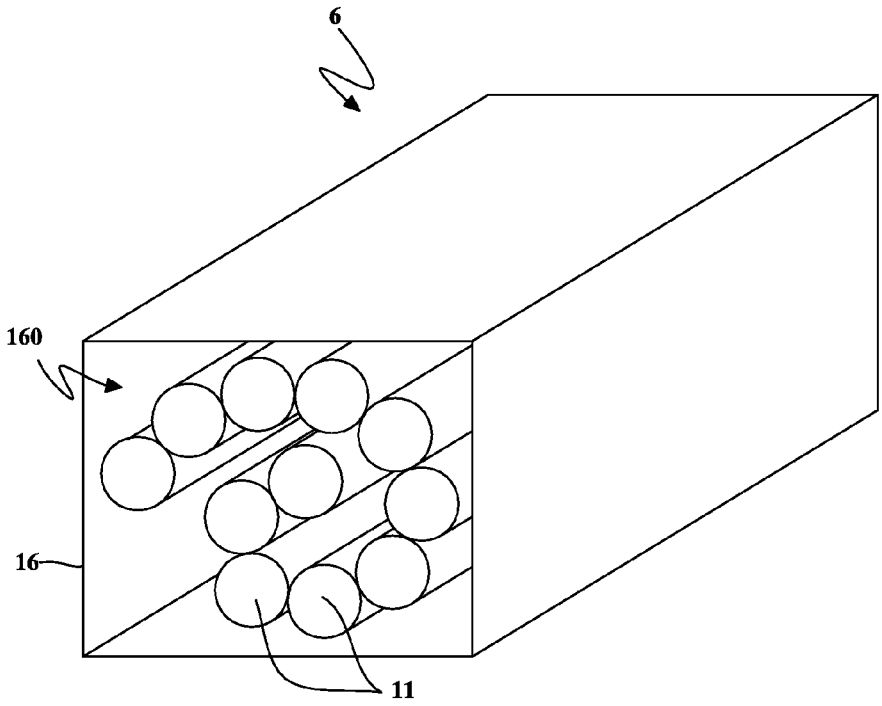
Figure 3C:
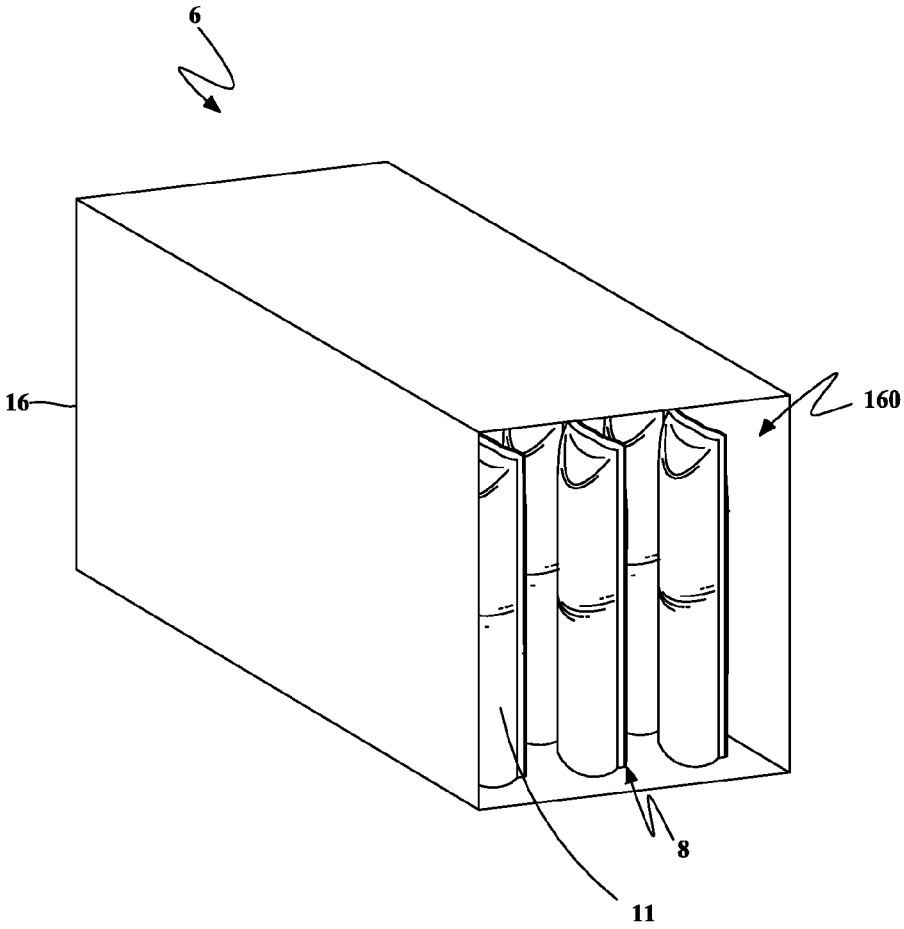
Figure 3D:
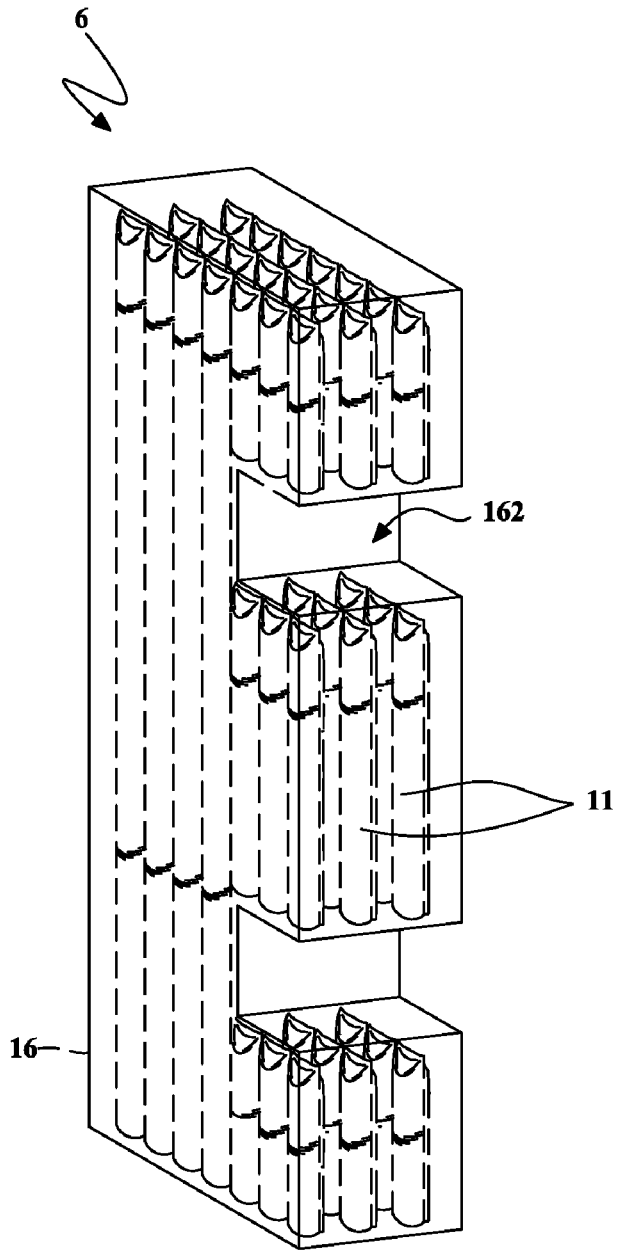

Please refer to FIGS. 2A, 2B and 2C. FIGS. 2A, 2B and 2C are schematic views respectively showing a bended air enclosure of a first preferred embodiment according to the present invention.

In order to be able to wrap the article 20 more completely, the sheet body 15 can be cut out to a proper shape or size, or bending is processed on the sheet body 15 to enable the sheet body 15 to be more attached to the article 20, for example, bend the sheet body 15 to a curved face to allow the sheet body 15 to attach onto a surface of the article completely or bend the sheet body 15 to a circular cylinder to allow the article 20*t* to be accepted in a space in the circular cylinder and provide the article 20 with the cushioning protection through the air chambers 11. If the accepted article 20 has a sharp angle, the sharp angle can be prevented from piercing through the air chamber 11 to cause air to be leaked out by means of the sheet body 15. Besides, the sheet body 15 can also be bended to more than one right angle and two sheets of the sheet body 15 perpendicular to each other can be respectively stuck onto the air chambers 11, or the air chambers 11 can also be bended along the nodes 14*a* and stuck onto the sheet body 15, Moreover, if the sheet body 15 is made from polypropylene (PP) or EPE, it can further provides the article 20 with secondary cushioning to enforce the shock-absorbed cushioning effect.

The air cylinder sheet 8 can be bended along the nodes 14*a* and two sides of the air cylinder sheet 8 are stuck together to form a bag by means of hot sealing and thereby the article 20 can be accepted in the bag to provide the article 20 with the cushioning function, in which the sheet body 15 can be positioned on an inner surface of the bag and can also be positioned on an outer surface of the bag or on both inner and outer sides thereof simultaneously to prevent the air cylinder sheet 8 from being pierced through to cause air to be leaked out.

Please refer to FIGS. 3A, 3B, 3C and 3D. FIGS. 3A, 3B, 3C and 3D are schematic views respectively showing an air enclosure after being filled with air of a second preferred embodiment according to the present invention.

An air enclosure 6 with multilayer different kinds of substrates comprises a air cylinder sheet 8 and case 16.

The air cylinder sheet 8 is constituted by two outer films 2*a* and 2*b* and two inner films 1*a* and 1*b* and they are adhered to each other by means of hot sealing to form an air filling passageway 9, a plurality of air chambers and air entering passageways, in which a plurality of nodes 14*a* are also generated on the air chambers 11 by means of hot sealing to allow the air chambers 11 to be bended along the nodes 14*a*.

Figure 4A:
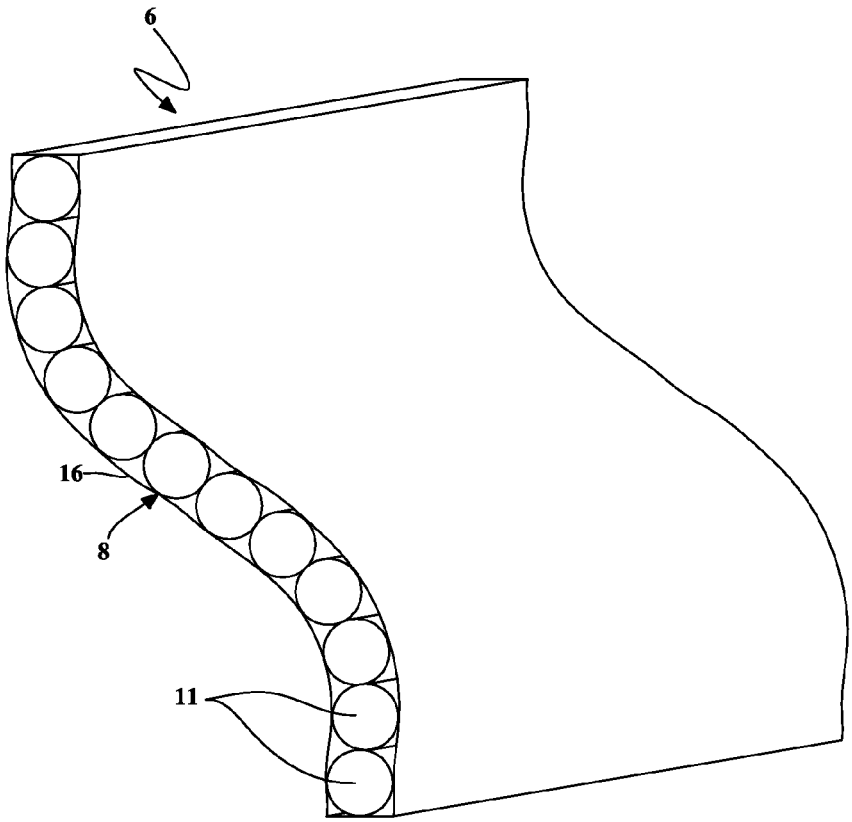
FIGS. 4A to 4G are schematic views, respectively showing a bended air enclosure of a second preferred embodiment according to the present invention.
Figure 4B:
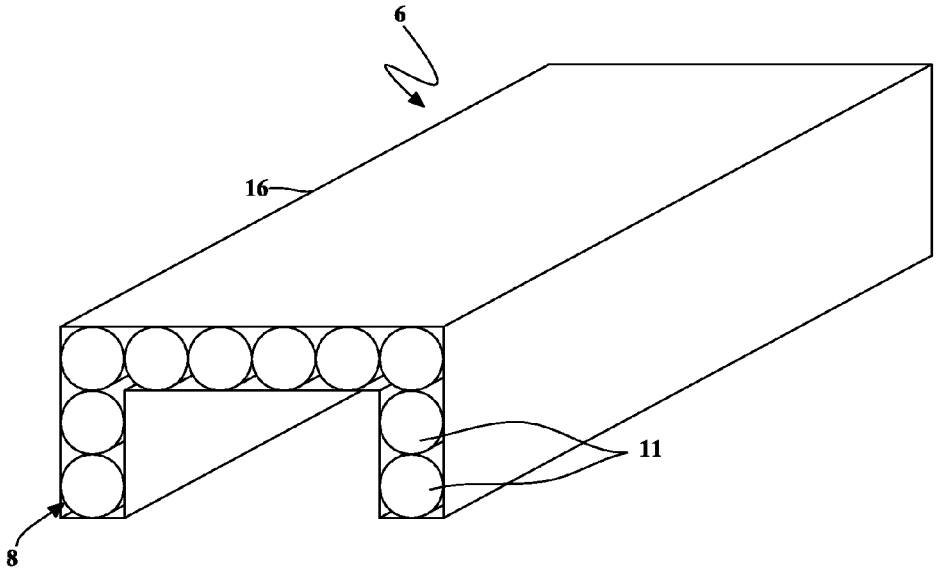
Figure 4C:
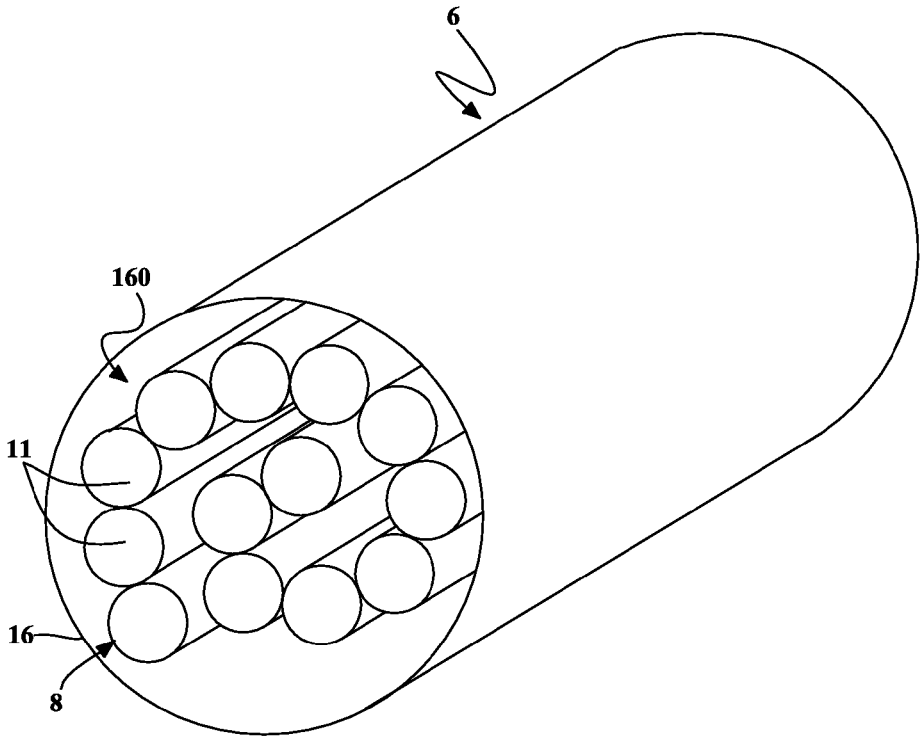
Figure 4D:
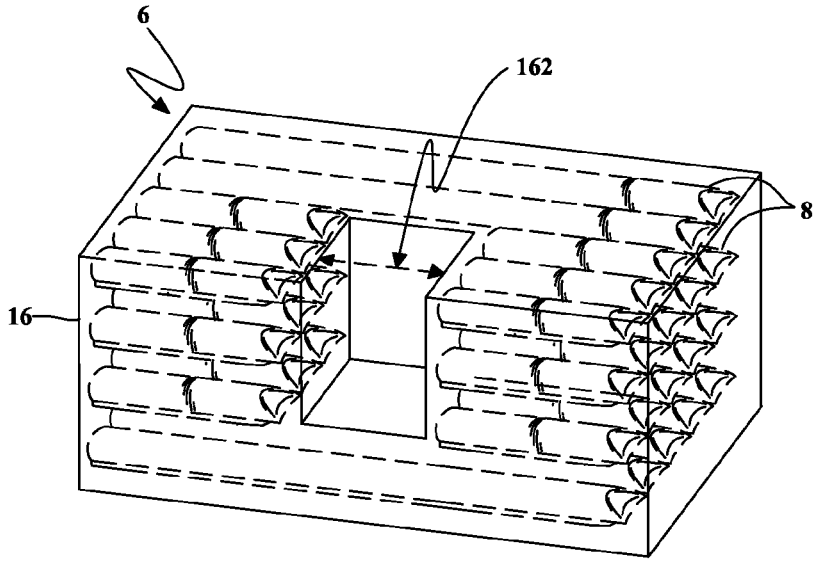
Figure 4E:
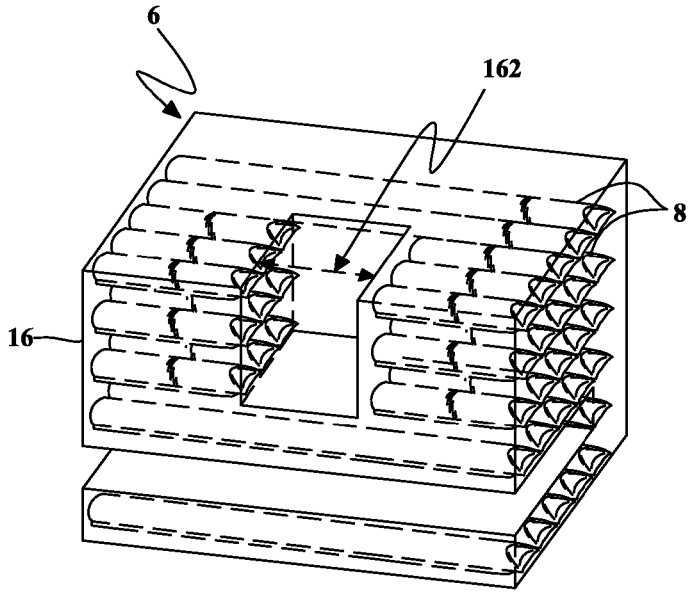
Figure 4F:
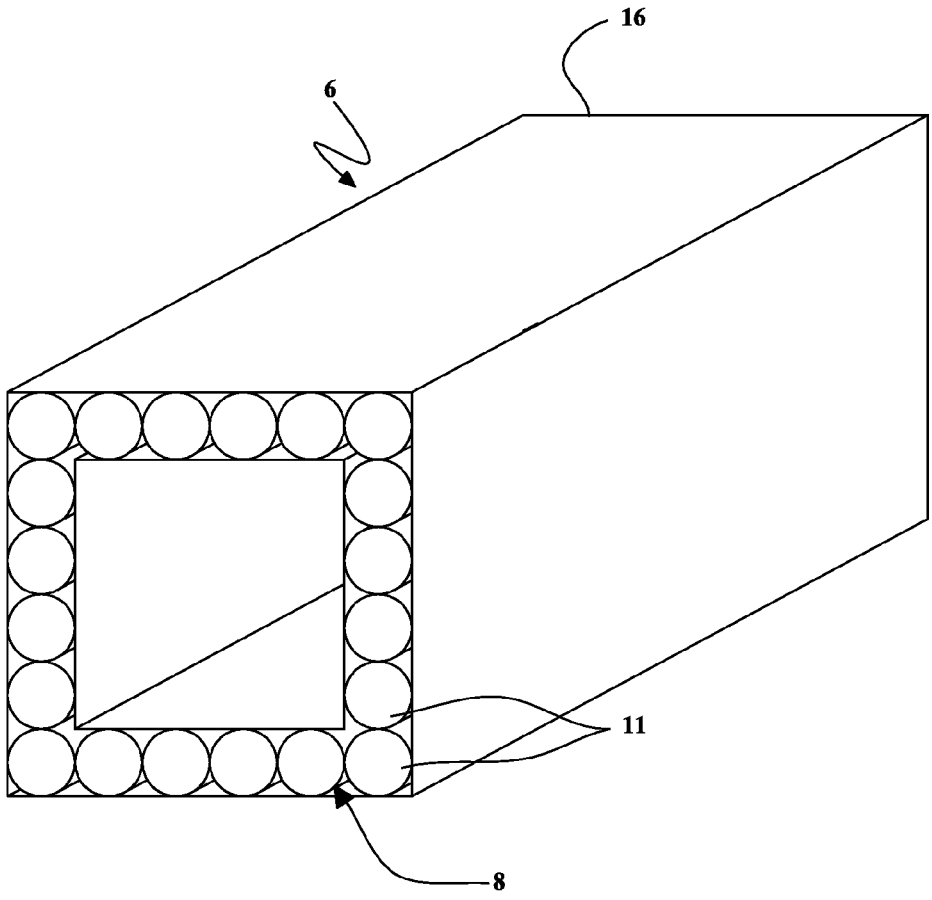
Figure 4G:
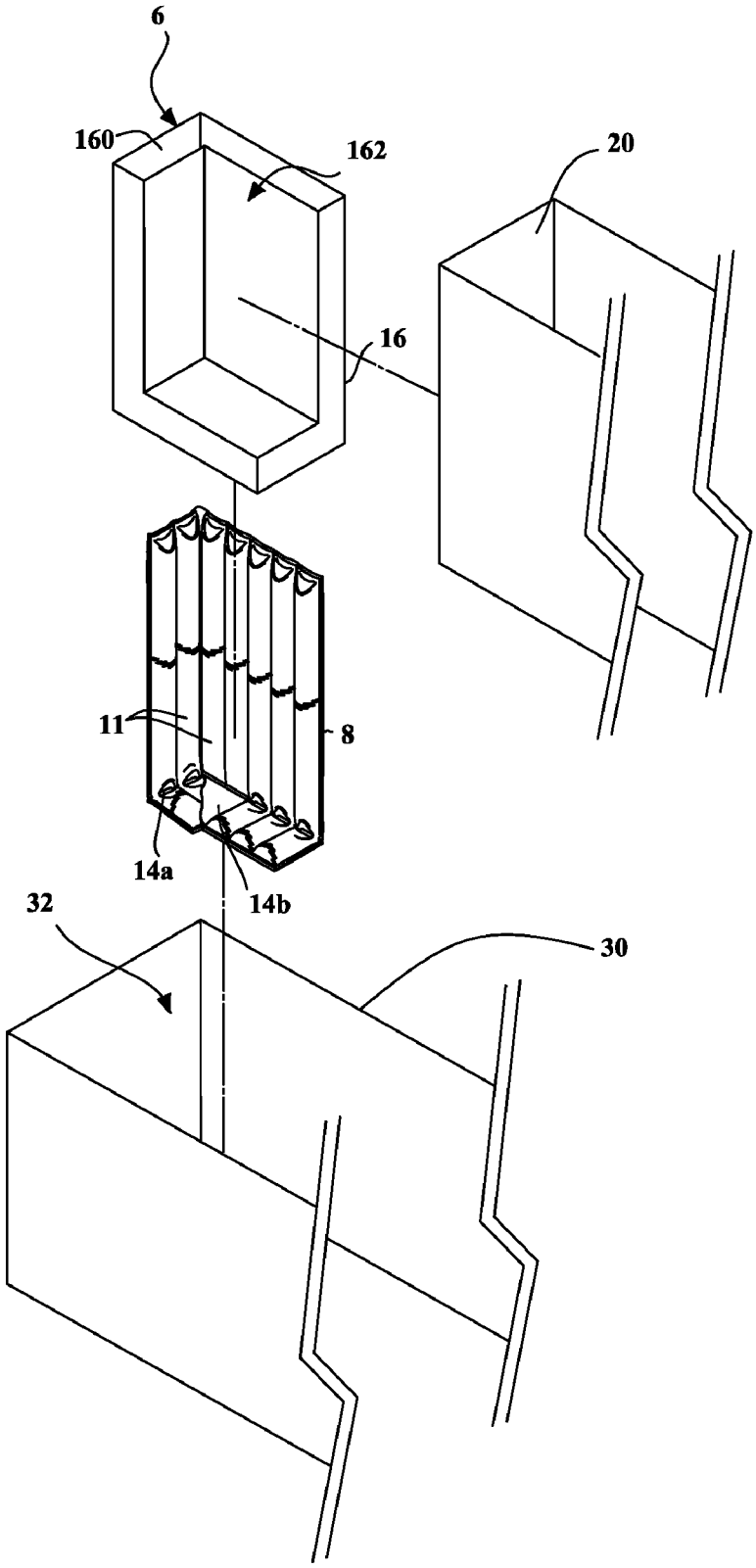
Figure 4H:
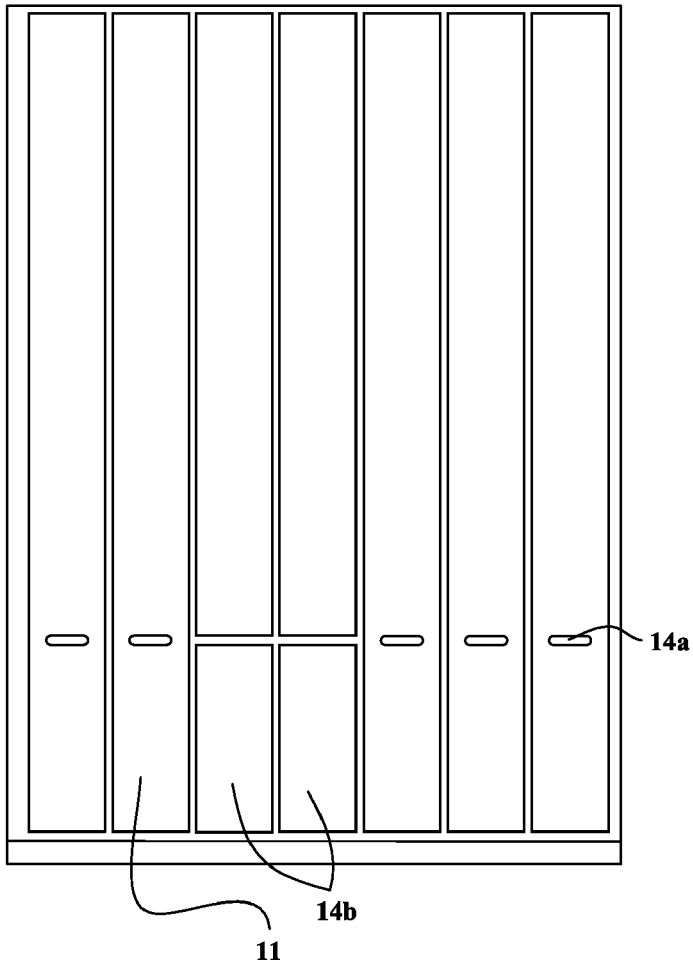
FIG. 4H is a plane view of an air enclosure shown in FIG. G before being filled with air.
Figure 5A:
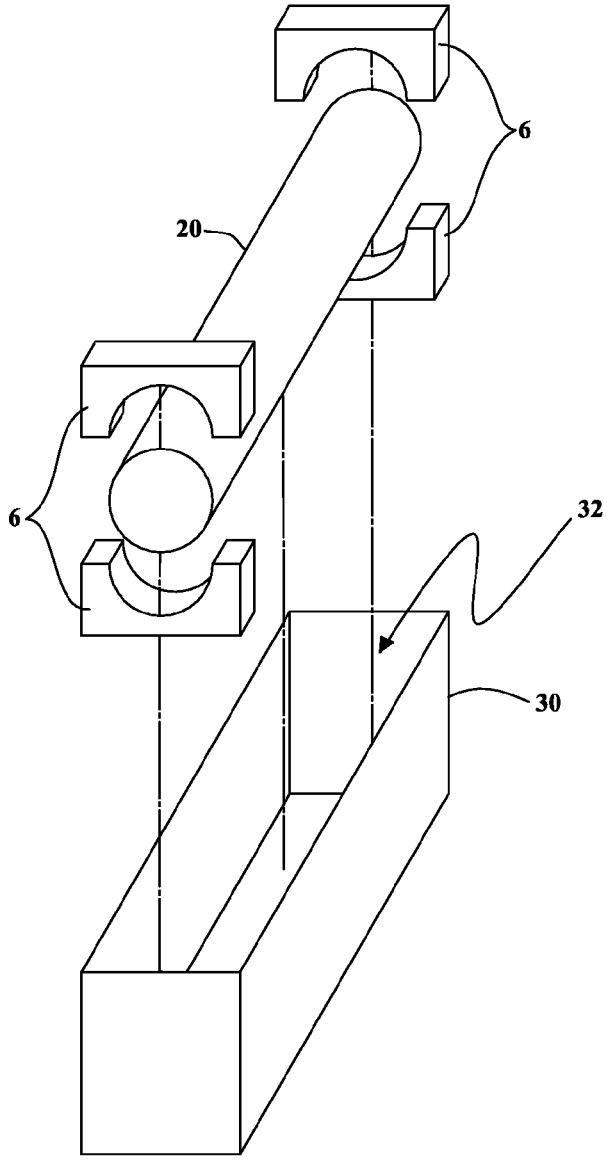
FIGS. 5A to 5D are schematic view, respectively showing an air enclosure in practical use of a second preferred embodiment according to the present invention.
Figure 5B:
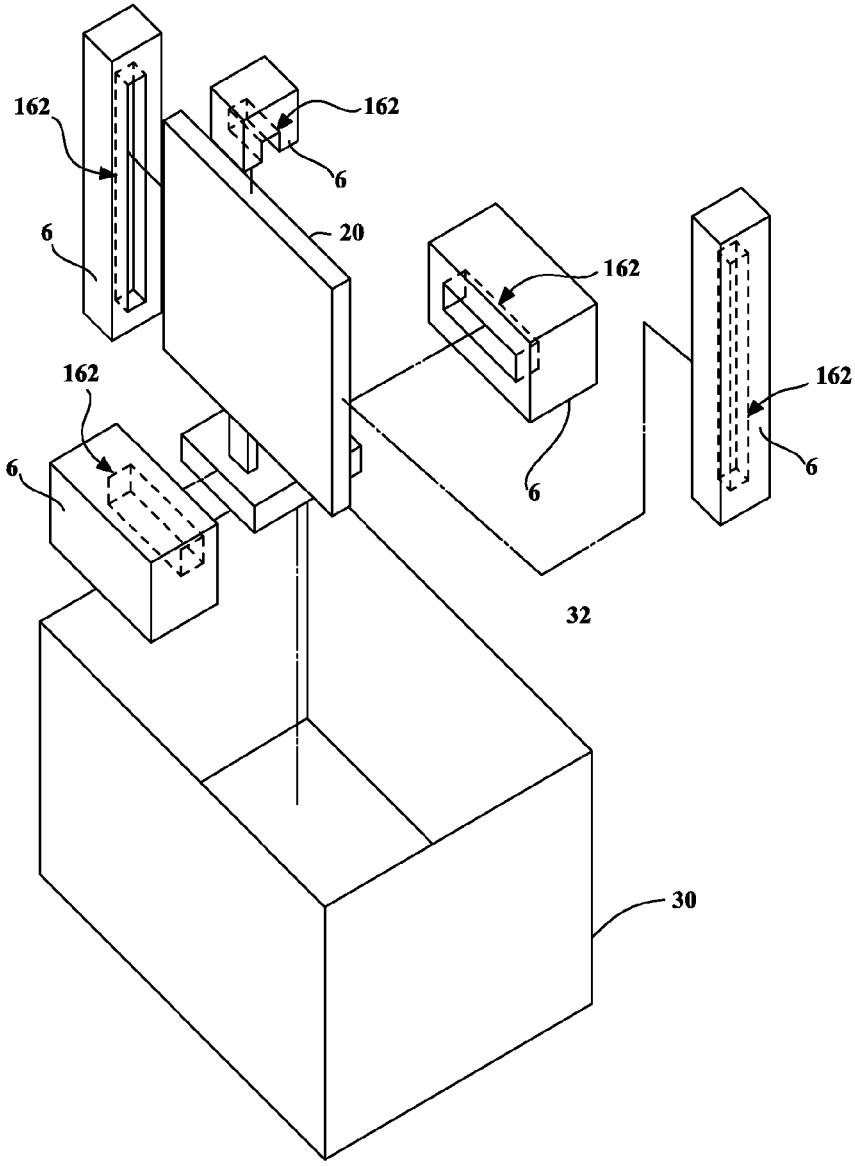
Figure 5C:
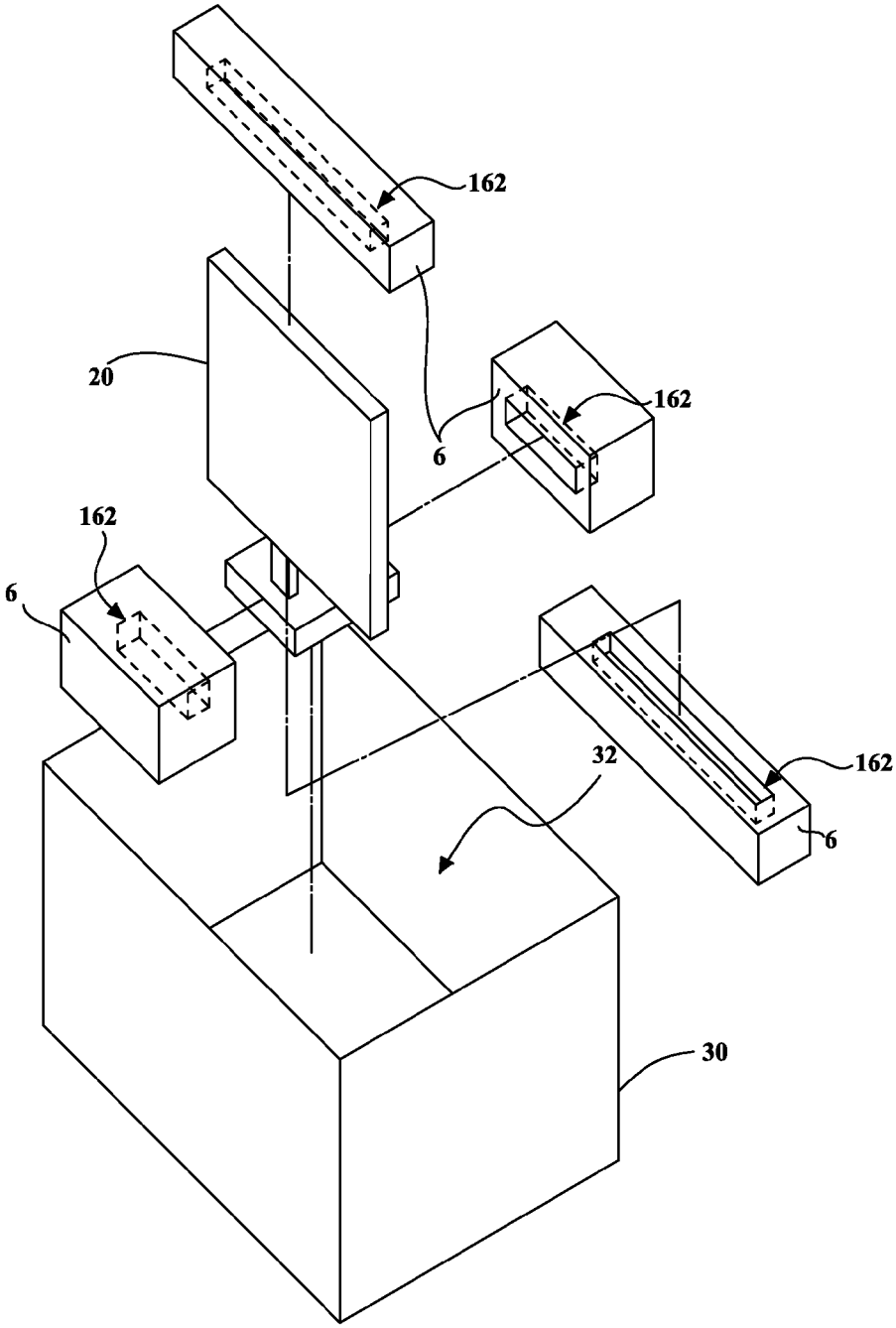
Figure 5D:
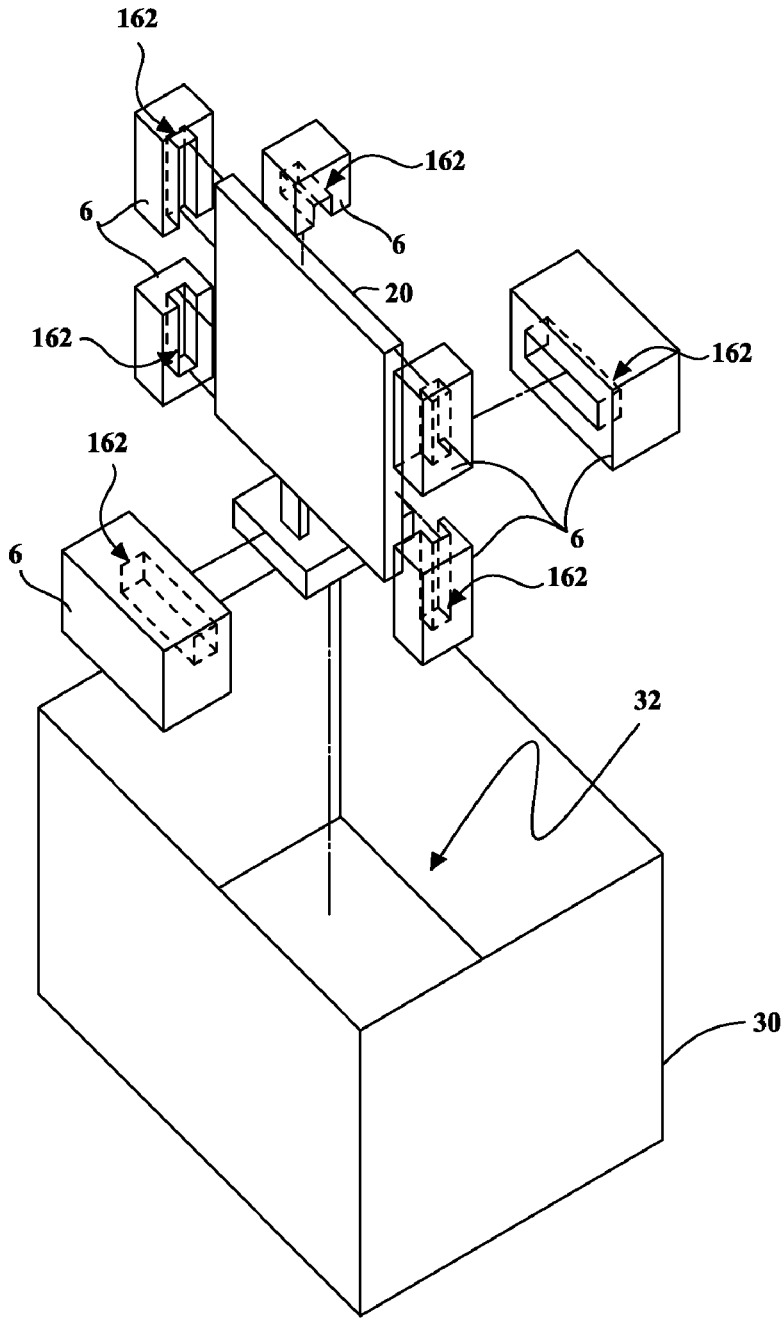

The case 15 is made from a soft material, for example, polyvinylchloride (PVC), polypropylene (PP), EPE, EPP, cloth or foam; it can also be made from corrugated paper, paper or paper-like material. The case 16 has a filling space 160 therein used for accepting a plurality of air chambers 11; the plurality of air chambers can be spread in parallel, stacked in sequence or arranged in a vertical disposition in the filling space 160, and fixed on the case 16 by means of adhering or stuck to fix into the filling space 160 by means of hot sealing.

please refer to FIGS. 4A to 4H. FIGS. 4A to 4G are schematic views respectively showing a bended air enclosure of a second preferred embodiment according to the present invention. FIG. 4H is a plane view showing a bended air enclosure shown in FIG. 4G before being filled with air.

For wrapping the article 20 more completely, a different shape or size of case 16, for example, italic with curved surfaces type case 16, square arch type case 16 or circular cylinder type case 16, can be used, and at least one air cylinder sheet 8 is placed in the filling space 160 of the case 16; this allows the article 20 with a different shape or size to be borne or clipped.

A clipping space 162 used for clipping one corner of the article 20 is also disposed on the case 16 to prevent the article 20 from being struck to scrape or damage during transportation. Moreover, the case 16 can be a square type case and the article is accept therein through a space in the middle of the case 16, and the case 16 accepting the article 20 can be placed into the outer box to form a box-in-box structure to enforce the shock absorbed cushioning protection function.

Furthermore, an air-filling forbidding zone 14*b* is disposed on the middle air chambers 11 of the air cylinder sheet 8 to allow the air cylinder sheet to be bended along the nodes 14*a* and then bended along the air-filling forbidding zone 14*b* so as to allow the air cylinder sheet 8 to cushion and protect two faces perpendicular to each other and one side face thereof of the article 20 or three faces of the article adjacent to one another. Whereby, one single air cylinder sheet 8 is allowed to provide the multidirectional cushioning function to enforce the shock-absorbed cushioning effect of the air cylinder sheet 8.

Please refer to FIGS. 5A, 5B, 5C and 5D. FIGS. 5A, 5B, 5C and 5D are schematic views respectively showing an air enclosure in practice of a second preferred embodiment according to the present invention.

When the article 20 is a curved body, the case 16 can be disposed with a curved clipping face for clipping a curved face of the article 20 to allow the article 20 to be conveniently loaded into the accepting space 32 of the outer box 30 so as to attain to the shock absorbed cushioning protection effects.

Furthermore, when the article 20 is square, two square arch type cases 16 can be used to put around both upper and lower sides or both left and right sides of the article 20, and the article 20 is then loaded into the outer box 30. Otherwise, four L type cases 16 can be used to put around four corners of the article 20, and the article is then loaded into the outer box 30. Besides, a plurality of different sizes of cases 16 can be arranged to put around the article to enforce the shock-absorbed cushioning protection effect to the article depending on the article 20 or a user's requirement.

Furthermore, the air enclosure 6 with multilayer different kinds of substrates can first be placed into the outer box 30 while being used, and the article 20 is then loaded into the outer box 30; this can also attain to the shock-absorbed cushioning effect.

According to the structure disclosed by the present invention, the air filling passageway 9 is a space formed by adhering two outer films 2*a* and 2*b* together by means of hot sealing, a space formed by adhering two inner films 1*a* and 1*b* together by means of hot sealing or a space formed by adhering an inner film 1*a* to an outer film 2*a* by means of hot sealing. Moreover, if there is only one inner film 1*a*, a heat resistant material 1*c* can be spread between an inner film 1*a* and an outer film 2*a* so as to allow the heat resistant material 1*c* to be used as an air flowing passageway. Hot sealing mentioned above can be hot mold pressing.

The air cylinder sheet 8 or the air chambers can provide the good shock-absorbed cushioning effect, but it is easy to be pierced through by a sharp angle of the article to cause air to be leaked out. On the contrary, there is no worry over the sharp angle of the article 20 piercing through the sheet body 15 or the case 16, but the shock-absorbed cushioning effect to the article 20 cannot be provided. Therefore, the multilayer substrates are used according to the present invention to combine the merits of the both to enforce the air cylinder sheet 8 or the air chambers 11 such that it can prevent the sharp angle of the article 20 from piercing through the air chamber 11 to cause air to be leaked out. Furthermore, according to the present invention, a different shape or size of sheet body 15 or case 16 can be used to wrap the article 20, partly wrapping or completely wrapping the article 20 can be chosen and the cushioning protection is provided for the article 20 through the air chambers 11. After the article 20 is wrapped with the air cylinder sheet 8 and the sheet body 15 or the case 16, it can then be placed into the accepting space 32 of the outer box 30 so as to be convenient for a user to transport the article 20.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A multilayer air enclosure with different kinds of substrates, adapted to cover an article thereby providing a cushioning protection, and including an air cylinder sheet, the air cylinder sheet comprising:

two outer films, stacked together vertically;

two inner films, positioned between the two outer films;

an air filling passageway, being a space formed by sticking the two outer films together by a first hot sealing portion and a second hot sealing portion, wherein the first hot sealing portion sticking the two outer films, the second hot sealing portion sticking the two outer films to the two inner films;

a plurality of hot sealing points, positioned between the first hot sealing portion and the second hot sealing portion so as to lie in the air filling passageway, each hot sealing point lying in between one sheet of the outer films and one sheet of the inner films to stick one sheet of the outer films to one sheet of the inner films;

at least one chamber, disposed at one side of the air filling passageway, being an air storing space formed by sticking the two outer films together by means of hot sealing and providing the article with the cushioning protection; and at least one air entering passageway, connected to the air filling passageway and the air chamber, formed by spreading a heat resistant material distantly and sequentially on one face of one of the inner films, the face then not stuck to a face of the other one of the inner films by the hot sealing, the outer films being forced apart outwardly when outside air enters and expands the air filling passageway, the two sheets of the unstuck inner films being driven to pull apart outwardly by the hot sealing points to open the air entering passageway, causing the outside air in the air filling passageway entering the air chambers through the air entering passageway to allow the air chambers to be filled with air and expanded, the outside air entering the air cylinder and then compressing the inner film to cover the air entering passageway to shield the air chamber; and a sheet body, closely attached onto one side of the air cylinder sheet used to prevent air cylinder sheet damage due to piercing.

2. The air enclosure according to claim 1, further comprising an outer box used for accepting the air cylinder sheet, the sheet body and the article thereby being convenient for transportation.

3. The air enclosure according to claim 1, wherein adhering or hot sealing is used for fixing the air cylinder sheet onto one side of the sheet body.

4. The air enclosure according to claim 1, wherein at least one node is formed on the air cylinder sheet by means of hot sealing to allow the air cylinder sheet to be bent along the node.

5. The air enclosure according to claim 4, wherein two sides of the air cylinder sheet are adhered to each other to form a bag by means of hot sealing after the air cylinder sheet is bent along the node.

6. The air enclosure according to claim 5, wherein the sheet body is disposed on an inner surface or an outer surface of the bag.

7. The air enclosure according to claim 1, wherein the air cylinder sheets are spread on one side of the sheet body in parallel.

8. The air enclosure according to claim 1, wherein the air cylinder sheets are stacked on one side of the sheet body in sequence.

9. The air enclosure according to claim 1, wherein the air cylinder sheets are arranged in a vertical disposition on one side of the sheet body.

10. The air enclosure according to claim 1, wherein the sheet body is levelly attached on a surface of the air chamber.

11. The air enclosure according to claim 1, wherein the sheet body is bent to form a circular cylinder.

12. The air enclosure according to claim 1, wherein the sheet body is bent to form a curved face.

13. The air enclosure according to claim 1, wherein the sheet body is bent to form at least one right angle to wrap the article.

14. The air enclosure according to claim 13, wherein at least one node is formed on the air chamber by means of hot sealing to allow the air chamber to be bent along the node to closely attach on one side of the sheet body.

15. The air enclosure according to claim 13, wherein at least one air filling forbidding zone is formed on the air chamber by means of hot sealing to allow the air chamber to be bent to cushion and protect three adjacent faces of the article along the air filling forbidding zone.

16. The air enclosure according to claim 13, wherein the sheet body is bent to form a case, and the case comprises a filling space used for accepting the air cylinder sheet.

17. The air enclosure according claim 1, wherein the sheet body is made from a soft material.

18. The air enclosure according to claim 17, wherein the soft material is chosen from a group consisting of cloth and foam.

19. The air enclosure according to claim 17, wherein the soft material is chosen from a group consisting of corrugated paper, paper and paper-like material.

20. The air enclosure according to claim 17, wherein the soft material is chosen from a group consisting of polyvinyl-chloride (PVC), polypropylene (PP), EPE and EPP.

* * * * *